US009366127B1

(12) United States Patent
McCoy

(10) Patent No.: US 9,366,127 B1
(45) Date of Patent: Jun. 14, 2016

(54) GAS SEPARATOR WITH INTEGRAL PUMP SEATING NIPPLE

(71) Applicant: James N. McCoy, Wichita Falls, TX (US)

(72) Inventor: James N. McCoy, Wichita Falls, TX (US)

( * ) Notice: Subject to any disclaimer, the term of this patent is extended or adjusted under 35 U.S.C. 154(b) by 625 days.

(21) Appl. No.: 13/766,916

(22) Filed: Feb. 14, 2013

(51) Int. Cl.
*E21B 43/38* (2006.01)

(52) U.S. Cl.
CPC ..... *E21B 43/38* (2013.01)

(58) Field of Classification Search
CPC ..... E21B 43/38
See application file for complete search history.

(56) References Cited

U.S. PATENT DOCUMENTS

| | | | | |
|---|---|---|---|---|
| 1,578,720 | A | 3/1926 | Derby | |
| 1,592,079 | A * | 7/1926 | Chancellor et al. | 166/105.1 |
| 1,665,540 | A | 4/1928 | Green | |
| 2,429,043 | A | 4/1943 | Barnhart | |
| 2,525,233 | A | 6/1947 | Miller | |
| 2,528,448 | A | 10/1950 | Munk | |
| 2,618,339 | A * | 11/1952 | Glover | 166/114 |
| 2,748,719 | A | 6/1956 | Wells | |
| 2,764,102 | A | 9/1956 | Abdo et al. | |
| 2,843,053 | A | 7/1958 | Carle | |
| 2,872,985 | A | 2/1959 | Bertuzzi et al. | |
| 2,883,940 | A | 4/1959 | Gibson | |
| 3,128,719 | A | 4/1964 | Jongbloed et al. | |
| 3,791,444 | A | 2/1974 | Hickey | |
| 3,818,986 | A * | 6/1974 | Abney et al. | 166/51 |
| 4,074,763 | A | 2/1978 | Stevens | |
| 4,088,459 | A | 5/1978 | Tuzson | |
| 4,231,767 | A | 11/1980 | Acker | |
| 4,241,788 | A | 12/1980 | Brennan | |
| 4,366,861 | A | 1/1983 | Milam | |
| 4,481,020 | A | 11/1984 | Lee et al. | |
| 4,531,584 | A | 7/1985 | Ward | |
| 4,573,529 | A | 3/1986 | Reinhardt | |
| 4,624,310 | A | 11/1986 | Echols et al. | |
| 4,676,308 | A | 6/1987 | Chow et al. | |
| 4,867,242 | A | 9/1989 | Hart | |
| 5,271,725 | A | 12/1993 | Freet et al. | |
| 5,343,945 | A | 9/1994 | Weingarten et al. | |
| 5,653,286 | A | 8/1997 | McCoy et al. | |
| 6,199,636 | B1 * | 3/2001 | Harrison | 166/328 |
| 6,237,691 | B1 | 5/2001 | Kelley et al. | |
| 7,104,321 | B2 | 9/2006 | Carruth | |
| 7,475,731 | B2 * | 1/2009 | Victor | 166/372 |
| 2002/0096327 | A1 * | 7/2002 | Kobylinski et al. | 166/265 |
| 2014/0110133 | A1 * | 4/2014 | Ellithorp | 166/378 |

OTHER PUBLICATIONS

Spirit Global Energy Solution—Downhole Gas Separator PDF file: SpecSheet_gassep.pdf.

* cited by examiner

*Primary Examiner* — David Andrews
*Assistant Examiner* — Michael Goodwin
(74) *Attorney, Agent, or Firm* — Dan Brown Law Office; Daniel R. Brown

(57) ABSTRACT

An oil well gas separator that includes a seating nipple for a downhole pump. An inner and outer barrel define a fluid passage and a separation annulus with the well casing. A separated well liquid passage is directly connected to the pump inlet to reduce dissolution of gas from the separated liquid. An isolation means is provided to isolate the separation annulus from the well casing fluids.

43 Claims, 11 Drawing Sheets

API Type RHB Pump

API Type RHA Pump

14

50

Section - A

Section - B

Section - C

GAS SEPARATOR WITH INTEGRAL PUMP SEATING NIPPLE

BACKGROUND OF THE INVENTION

1. Field of the Invention

The present invention relates to the separation of gas and liquid from gas-liquid mixtures on a continuous basis, and relates more specifically to downhole gas separators used with sucker rod pumps in oil and gas wells.

2. Description of the Related Art

In oil and gas reservoirs, petroleum oil is frequently found in intimate association with natural gas, both in the form of free gas bubbles entrained in the oil and in the form of dissolved gas in the oil. Water is also commonly present in the reservoir fluids. Thus, well fluids commonly comprise both liquids and gas. In wells where pumping is necessary, the presence of this gas-liquid mixture materially affects the efficiency of pumping operations. In addition to the free gas in the mixture, the pressure decrease inherent at the suction of the pump inlet causes some of the dissolved gas to form more bubbles of free gas. The bubbles of free gas occupy part of the displacement of the pump, which results in reduced pumping efficiency. If the quantity of gas accumulates to a sufficient proportion, it will expand and contract to such a degree that the pump becomes gas locked, unable to cycle its flow control valves, and unable to pump any liquids at all.

A downhole reciprocating rod pump is the most common type of well pump being used today. Typically, the rod pump is run down inside the tubing string using a sucker rod string until it engages a seating nipple that is fixed to the tubing string, which then locates the inlet port of the rod pump at the depth of the seating nipple, and fixes the rod pump in position for pumping operation. The rod pump is then driven by a reciprocating surface unit through the string of sucker rods. The downhole pump pumps well liquids to the surface through the tubing string, while gas occupies an annulus between the tubing string and the well casing. The seating nipple and suction inlet of the pump are positioned below the liquid level in the well. In wells where bubbles of gas are present, it is known in the art to use a gas separator ("gas anchor") to continuously separate the gas from the liquids before the liquid enters the inlet of the pump, the liquids being directed to the suction inlet of the pump and the gas being directed to the casing annulus. Thus, the gas separator is typically fluidly coupled to the suction inlet of the rod pump, and is therefore located below the rod pump itself. The efficiency of the separation of liquid and gas by the gas separator is a critical aspect of the gas separator design, and it should be noted that no gas separator is totally effective in this separation process.

Since prior art gas separators are located below the inlet of the downhole rod pump, the length of the rod pump and gas separator add together to establish the total depth below the well's natural liquid level that is required to properly submerge this equipment. Also, where the gas separator is below the rod pump, the liquid gas separation activity occurs below the pump as the liquids are drawn into the suction inlet of the pump by differential pressures. Thus, the length of the gas separator is related to the amount of differential pressure needed to draw the liquid and gas mixture through the gas separator and into the rod pump. This differential pressure is a negative pressure, which naturally draws some additional dissolved gasses out of solution. Any additional gases drawn out of solution at any point after the gas/liquid separation function of the gas separator has been completed, results in a direct reduction of pump efficiency since these gases must be compressed to at least the pump discharge pressure before any liquid is expelled from the pump.

In addition to the gas-liquid separation efficiency of the gas separator, it should be appreciated that the gas separator is typically located thousands of feet below the surface, so reliability is also critically important. It is further important for a gas separator design to facilitate its insertion and removal from the well bore casing using conventional oil field service systems and techniques. It is further important to address the practicalities of well field operations, including abusive handling practices, well fluid impurities, solids, abrasion, and unexpected failure of other well components. Given the high value of efficient oil and gas well production, the expense of operating and maintaining wells, and the cost of servicing well, it can readily be appreciated that there is a need in the art for cost effective, reliable, and efficient gas-liquid separators.

SUMMARY OF THE INVENTION

The need in the art is addressed by the apparatus of the present invention. The present disclosure teaches a gas separator useful to increase liquid concentration of a well fluid, which includes both gas and liquid, and for use with a pump that has a seating assembly, and which discharges into a tubing string that is located within a casing. The separator includes a seating nipple with an interior cavity that engages and retains the seating assembly of the pump. An inner barrel is sealably coupled between the tubing string at its upper end and the seating nipple, and accommodate a portion of the pump therein. An outer barrel is disposed about the exterior of the inner barrel and the seating nipple, and defines a well fluid annulus therebetween, and further defines a separation annulus with the casing. The outer barrel has a well fluid outlet located above the seating assembly for transferring wells fluids from the well fluid annulus to the separation annulus, and the outer barrel also has well fluid inlet located below the seating nipple, which enables well fluids to enter the fluid annulus. A liquid passage connects the exterior of the outer barrel and the interior cavity of the seating nipple, which enables well liquids to flow from the separation annulus into the interior cavity of the seating nipple and then into the pump inlet. An isolation means is disposed between the casing and the separator, and is located below the well liquid passage and above the well fluid inlet. Thus, the isolation means prevents the flow of well fluids upwardly into the separation annulus. In operation, well fluids that flow into the separation annulus from the well fluid outlet are subject to gravity separation such that the gaseous portion rises within the separation annulus, and the liquid portion falls to the well liquid passage.

In a specific embodiment of the foregoing separator, the outer barrel is sealably coupled to the inner barrel at its upper end. In another embodiment, the well fluid outlet is formed through a sidewall of the outer barrel. In another embodiment, the inner barrel is elongated to accommodate a portion of the length of the pump within the separator.

In a specific embodiment, the foregoing separator further includes a draw tube coupled to the well fluid inlet and extending downwardly therefrom, and the isolation means is a low pressure flow diverter assembly disposed about the draw tube. In a refinement to this embodiment, the low pressure flow diverted includes plural separator discs that slidably engage the draw tube and the casing. In another specific embodiment, the isolation means is a casing pack-off assembly coupled to the well fluid inlet, which prevents the flow of high pressure well fluid into and out of the separation annulus. In a refinement to this embodiment, the separator includes tubing anchor coupled to the separator, which rigidly fixes the separator with respect to the casing.

In a specific embodiment, the foregoing separator further includes a tail pipe coupled to the well fluid inlet that extends to a substantially greater depth in the casing that the depth of the separator in the casing, which is for drawing well fluids upward from the substantially greater depth. In another embodiment, the foregoing separator further includes a check valve coupled to the well fluid inlet, and oriented to allow well fluid flow upwardly into the well fluid inlet only.

In a specific embodiment of the foregoing separator, the well liquid conduit is located less then twelve inches from the pump inlet. In another embodiment, where the pump is a rod insert pump oil well pump with a cup type seating assembly, the seating nipple is a cup type seating nipple. In another embodiment, where the pump is a oil well rod insert pump with a mechanical type seating assembly, the seating nipple is a mechanical type seating nipple.

In a specific embodiment of the foregoing separator, the outer barrel further includes an upper outer barrel portion and a lower outer barrel portion. The lower barrel portion has a larger diameter than the upper outer barrel portion, and it is disposed around the seating nipple to provide increased clearance for well fluids that flow within the well fluid annulus. In another specific embodiment, the inner barrel and the outer barrel are elongated with lengths within the range of three to forty feet.

In a specific embodiment of the foregoing separator, the isolation means is configured as a disc with an outer diameter selected to fit within an interior diameter of the casing, and a mounting hole formed through it and sized to engage an exterior surface of the outer barrel. In a refinement to this embodiment, the disc is formed of a polymeric material. In a further refinement, the polymeric material is selected from selected from polyethylene, acetal, fluoropolymers and fluoroethelenes.

The present disclosure teaches a gas separator that increases liquid concentration of a well fluid, which includes gas and liquid, for use with a pump that has a seating assembly at its upper end and a pump inlet at a lower end of a pump body, and which discharges into a tubing string that is located within a casing. The separator includes a seating nipple with an interior cavity that engages and retains the seating assembly of the pump. An inner barrel is coupled to the seating nipple at its upper end, and extends downwardly around the pump to enclose the pump body, including the pump inlet. An outer barrel is disposed around the exterior of the inner barrel, and is coupled to the seating nipple, thereby defining a well fluid annulus between the inner barrel and the outer barrel. The outer barrel further defines a separation annulus with the casing. The outer barrel also has a well fluid outlet located adjacent to the upper end for transferring well fluids from the well fluid annulus to the separation annulus. The outer barrel also has a well fluid inlet located below the pump inlet, which enables well fluids to enter the fluid annulus. A liquid passage is disposed between the exterior of the outer barrel and the inner barrel at a location adjacent to the pump inlet, which enables well liquids to flow from the separation annulus into the inner barrel and into the pump inlet. An isolation means is disposed between the casing and the separator, and is located below the well liquid passage and above the well fluid inlet. Thus, the isolation means prevents the flow of well fluids upwardly into the separation annulus. In operation, well fluids that flow into the separation annulus from the well fluid outlet are subject to gravity separation such that the gases rises within the separation annulus, while the liquids fall to the well liquid passage.

In a specific embodiment, the foregoing separator further includes a draw tube coupled to the well fluid inlet that extends downwardly, and the isolation means is a low pressure flow diverter assembly disposed about the draw tube. In a refinement to this embodiment, the low pressure flow diverted further includes plural separator discs that slide along the draw tube and the casing. In another specific embodiment, the isolation means includes a casing pack-off assembly coupled to the well fluid inlet, which prevents the flow of high pressure well fluid into and out of the separation annulus.

In a specific embodiment, the foregoing separator further includes a tubing anchor coupled to the separator, which rigidly fixes the separator with respect to the casing. In another embodiment, the separator further includes a tail pipe coupled to the well fluid inlet that extends to a substantially greater depth in the casing that the depth of the separator in the casing, which is for drawing well fluids upward from the substantially greater depth.

In a specific embodiment, the foregoing separator further includes, a check valve coupled to the well fluid inlet, and oriented to allow well fluid flow upwardly into the well fluid inlet only. In another embodiment, the well liquid passage is located less then twelve inches from the pump inlet.

In a specific embodiment of the foregoing separator, where the pump is a rod insert pump oil well pump with a cup type seating assembly, the seating nipple is a cup type seating nipple. In another embodiment, where the pump is a oil well rod insert pump with a mechanical type seating assembly, the seating nipple is a mechanical type seating nipple.

In a specific embodiment of the foregoing separator, the inner barrel and the outer barrel are elongated with lengths within the range of three to forty feet.

The present disclosure teaches a gas separator for use in a casing of a well that produces well fluids, including liquids and gases, and that employs a downhole pump with a seating assembly at its lower end, and where the well has a tubing string located within a casing. The gas separator includes a top collar with a central passage located at an upper end of the gas separator, which couples to the tubing string. There is a seating nipple configured to receive the seating assembly of the downhole pump, thereby retaining the downhole pump in a fixed position with respect to the tubing string. The seating nipple has a liquid inlet adjacent to the pump inlet for receiving well liquids into the pump. An inlet fitting is located at a lower end of the gas separator, and has a well fluid inlet arranged to route well fluids around the exterior of the seating nipple. A draw tube is coupled to the inlet fitting and extends downward, which then defines a lower annulus between the well casing and the drawtube. A lower isolation means is placed around the draw tube, and engages the casing to prevent the flow of well fluids upwardly through the lower annulus. An inner barrel is coupled between the seating nipple and the central passage of the top collar, and is configured to accommodate the downhole pump inside, which enables the downhole pump to discharge well liquids into the tubing string. An outer barrel is placed around the exterior of the inner barrel and the seating nipple, and is connected between the inlet fitting and the top collar. The outer barrel also has a well fluid outlet formed to deliver well fluids into a gravity separation annulus formed between the well casing and the outer barrel. The outer barrel also has a liquid inlet passage, which couples well liquids to the liquid inlet of the seating nipple. The inner barrel and the outer barrel define a well fluid annulus, through which well fluids are coupled from the well fluid inlet of the inlet fitting. In operation, the well fluids are discharged from the well fluid annulus through the well fluid outlet into the gravity separation annulus where the well gases rise within the casing annulus under force of gravity, and the well liquids fall under force of gravity to the liquid inlet passage and into the well liquid inlet in the seating nipple.

In a specific embodiment of the foregoing separator, the inner barrel is elongated to accommodate most of the length of the pump within the separator. In another embodiment, the isolation means is a low pressure flow diverter assembly disposed about the draw tube. In a refinement to this embodiment, the low pressure flow diverted also includes plural separator discs that slidably engage the draw tube and the casing. In another embodiment, the isolation means includes a casing pack-off assembly coupled to the well fluid inlet, which prevents the flow of high pressure well fluid into and out of the gravity separation annulus. In a refinement to this embodiment, the separator further includes a tubing anchor coupled to the separator, which rigidly fixes the separator with respect to the casing.

In a specific embodiment, the foregoing separator further includes a tail pipe coupled to the well fluid inlet that extends to a substantially greater depth in the casing than the depth of the gas separator in the casing, which is for drawing well fluids upward from the substantially greater depth. In another embodiment, the separator further includes a check valve coupled to the well fluid inlet that is oriented to allow well fluid flow upwardly into the well fluid inlet only. In another embodiment, the well liquid passage is located less then twelve inches from the pump inlet.

In a specific embodiment of the foregoing separator, where the pump is a rod insert oil well pump with a cup type seating assembly, the seating nipple is a cup type seating nipple. In another embodiment, where the pump is a oil well rod insert pump with a mechanical type seating assembly, the seating nipple is a mechanical type seating nipple.

In a specific embodiment of the foregoing separator, the outer barrel includes an upper outer barrel portion and a lower outer barrel portion. The lower outer barrel portion has a larger diameter than the upper outer barrel portion, and is disposed around the seating nipple to provide increased clearance for well fluid flowing within the well fluid annulus. In another specific embodiment, the inner barrel and the outer barrel are elongated with lengths within the range of three to forty feet.

DESCRIPTION OF THE INVENTION

Figure 1:
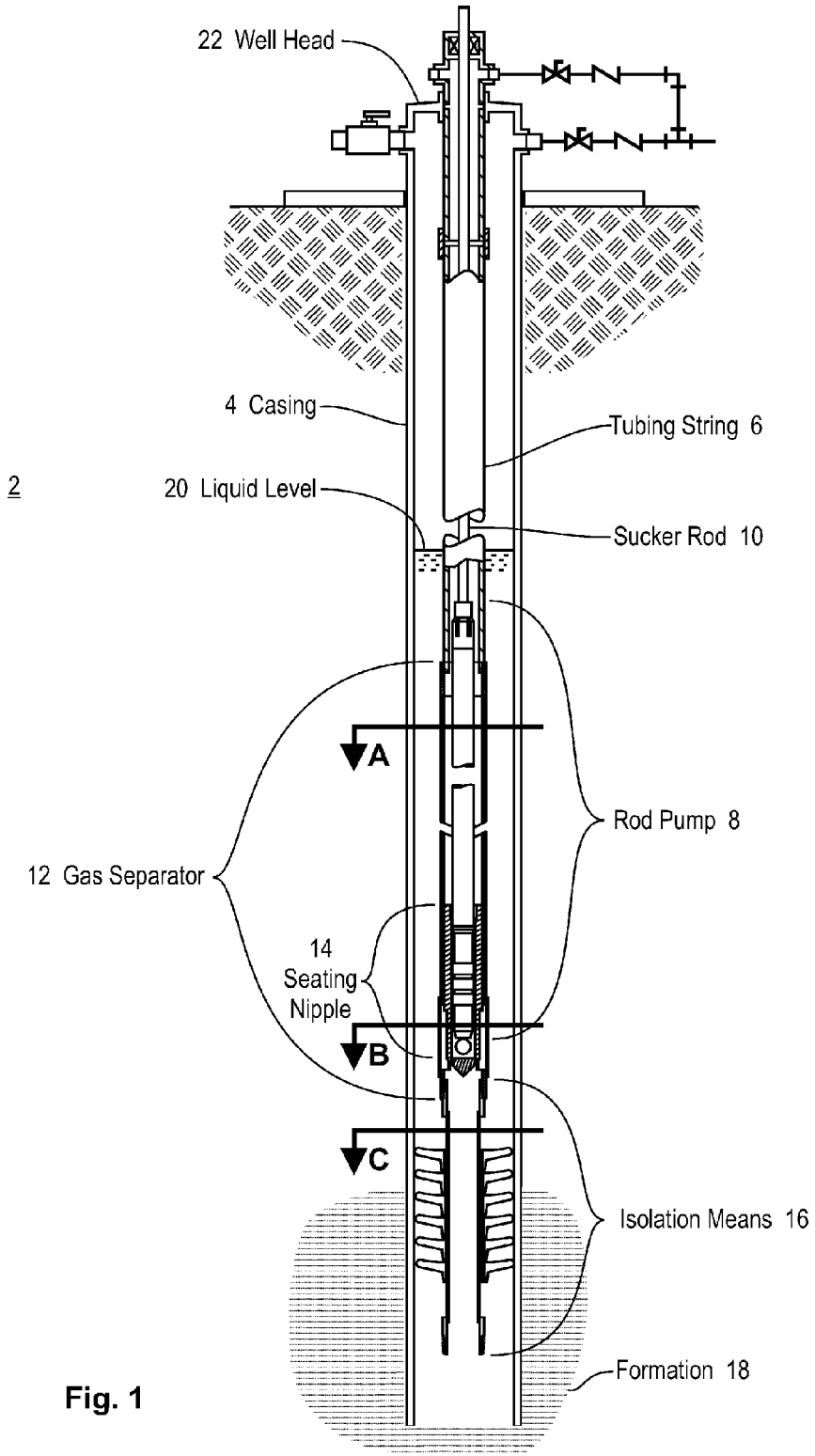
FIG. 1 is a section view of an oil well with rod pump, gas separator and isolation means according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

Most downhole liquid and gas separators, also referred to as "gas anchors", in use in the oil and gas industry employ gravity separation. The flow of well fluids, comprising crude oil, water, and gases, is routed into a vertical orientation where the gas bubbles are allowed to rise upwardly and out of the well liquids. The well liquids are drawn away and then pumped to the surface. In most oil wells, the gas flows out of the well through the well-bore casing, while the liquid is pumped to the surface through a tubing string that is disposed within the casing. As an aid to clarity, in this disclosure, "fluid" is used to describe a blend of both gas and liquids, which may contain crude oil and water, such as the raw well fluids that enter the well casing from the adjacent geologic formation. "Gas" is used to describe that portion of the fluids that comprises little or no liquids, which may include natural gas, carbon dioxide, hydrogen sulfide, and other gases in the case of an oil or gas well. And, "liquid" is used to describe fluids after the removal of a substantial portion of the gas therefrom. It will be appreciated by those skilled in the art that even the most efficient downhole gas separators often times do not remove 100% of the gas from the well liquids. This is due, in part, to the fact that some of the gases are soluble in the liquids such that changes in temperature, pressure, and mechanical agitation, can cause additional gas to escape from solution. The goal of any gas separator is to separate as much free gas from the fluids as possible, which enables the pumping efficient and production rate of the well to increase. Free gas is gas that is not in solution with the liquids. Dissolved gases are actually part of the liquids, and it is generally preferable to avoid dissolution of the dissolved gases.

Gas bubbles rise upwardly in oil or water under the force of gravity, and at a rate of approximately six inches per second. Thus, gas bubbles will be released from a fluid column if the downward liquid velocity is less than six inches per second. Therefore, in order to achieve gas separation by force of gravity, it is necessary to control the flow of well fluids in a separation region such that they move downwardly at a velocity of less than six inches per second. However, the solution to effective gas separation is not simply to move the fluids as slowly as possible because it is also desirable to move as high a volume of liquids out of the well as possible. A liquid column having an area of one square inch travelling at six inches per second is a flow rate of approximately fifty barrels per day. Thus, it is significant to consider the cross sectional area of the separation chamber in a gas separator, and the pumping volume, in determination of an optimum gas separator design. In a well bore having a four to six inch internal diameter, the allocation of cross section area for gas separation, liquid pumping, and other fluid routing functions is critical to efficient separator design.

In any gas separator design that employs gravity separation, there is a point in the flow processes where the liquid is drawn out of a separation chamber so that it can be fed to the inlet of the downhole pump, and then be pumped to the surface. The critical location in which it is most desirable to minimize the percentage of gas in the well liquids is in the downhole pump chamber. This is because the requirement to compress the gas portion to the high pump outlet pressure prior to the discharge of liquids from the pump outlet reduces the effective displacement of the pump, and thus directly affects the pump efficiency and maximum well production rate. In prior art gas separator designs, the gas separator is typically located below the downhole pump, and fluids are drawn upwardly through the gas separator to the pump inlet. Considering that the separation chamber portion of the gas separator must be oriented vertically for gravity to act, and that the gas rises while the liquids fall, it is necessary for the liquid portion to be drawn upward through most of the length of the gas separator to the pump inlet. This requires a negative pressure differential, which will naturally draw more gas out of solution, thus exacerbating the separation challenge.

Another aspect of gas separation in an oil and gas well is the location from which the raw well fluids are drawn into the pumping system. Considering a typical oil and gas well casing, there is a depth at which raw fluids from the adjacent formation flow into the well casing. In many wells, the casing is perforated to allow the formation fluids to drain into the casing. In other wells, the fluids may flow into the casing through an opening at the bottom of the casing. These raw well fluids contain liquids and gases. The gases naturally rise in a static well, and the liquids naturally fall. Once a well stabilizes, during times when there is no fluid removal by production operations, then a static formation pressure will stabilize, and a static liquid level within the casing will also stabilize. The static liquid level is referred to as the gas-liquid interface. In fact, the height of the liquid column from the gas-liquid interface to the formation perforations is determined by the static pressure at the formation. It will be readily appreciated that the pumping system must draw the well fluids in at a location below the static liquid level. However, it should be further noted that once pumping commences, the static liquid level will fall, depending on the rate liquids are pumped out of the well and the rate at which the formation can naturally drain well fluids into the casing. Also, once pumping commences, the movement of fluids out of the perforations and up to the pumping system suction inlet presents a dynamic fluid environment with turbulence and pressure gradients that generally become lower as fluids move upward. These are contributing factors in the dissolution of soluble gases from the well fluids.

With respect to the present invention, the pumping system comprises at least a pump and a gas separator that is located ahead of the pump inlet in the fluid flow path. Therefore, the inlet to the pumping and separation system may be the fluid inlet to the gas separator. However, the separator may employ either a drawtube or a tail pipe that reaches further downward into the well, and which establishes the location of the pumping system suction inlet. This is significant because it enables engineers and operators to decide about the location of the system inlet with respect to the formation, the static and dynamic gas-liquid interface, and other well production parameters.

In the case where the pumping system inlet is located below the point at which raw well fluids enter the casing, and there is adequate flow area, gas can rise upwardly through the annulus between the casing and the tubing, and almost none of the gas will enter the pumping system as long as the downward liquid velocity in the annulus doesn't exceed six inches per second. Thus, the primary concerns about gases are the dissolution by pressure changes and agitation within the pumping system. In the case where the pumping system inlet must be set at a high location due to operating constraints or in the case of horizontal wells where the pump generally is set shallower than the horizontal section, then gas separator installed ahead of the pump is preferred in order to eliminate the majority of the gas in the fluid before it reaches the pump intake. The disadvantage of using a gas separator is that it can only handle limited gas and liquid rates since all of the flow paths and channels have to fit inside the wellbore and consequently their dimensions and corresponding flow areas have to be smaller than those provided by the full casing annulus.

The present invention advantageously utilizes an annulus between the inside surface of the well casing and an outer barrel of the gas separator apparatus, referred to as the separation annulus, to yield the largest practicable sectional area as a separation chamber while still providing other fluid conduit requirements within the gas separator structure. In order to control the flow of fluids, liquids, and gas within the separation annulus, there must be an isolation means disposed within the well bore casing so that the separation annulus is not continuous with the casing that is located below the gas separator. This device is referred to herein as an isolation means, which can be implemented in several embodiments, including, but not limited to, a pack-off assembly and a flow diverter. Were there no isolation means, the gases from the raw well fluids would rise into the separation annulus and make it impractical to draw the liquid portion into the pumping system.

With respect to oil and gas well pumps, there are a wide variety known to those skilled in the art. The primary pumping mechanisms in use today are the reciprocating chamber pump, the progressive cavity pump, the electrical-submersible pump, and the jet-fluid pump. The reciprocating pump is used in the majority of wells that employ artificial lift. A typical reciprocating pump includes a stationary assembly and a traveling assembly. There is a pump inlet at the lower end of the stationary assembly, which is coupled to a standing valve located at the lower end of a pumping chamber. The traveling assembly reciprocates within a pump barrel portion of the stationary assembly, which has a travelling valve near its upper end. The two valves are check valves, which cooperate to draw well liquids into the pumping chamber and discharge them through the top of the pump assembly on successive strokes of the reciprocating drive. The top of the pump assembly discharges into a tubing string that connects to a surface well head. Thus the pump draws in fluids at the bottom and pumps them to the surface.

An important consideration in the process of drilling, operating, and maintaining an oil and gas well, is how the equipment is inserted into the well casing, how it is operated, and how it is serviced from time to time. Assuming the well has been drilled and a steel casing has been cemented in place and that the casing has been perforated in the region of the oil producing geologic formation, the remaining system components can be install and operated. A tubing string is run down the casing, and connects to the pump, which is coupled to a gas separator, and any other flow devices associated with the pumping system. A sucker rod is run down the inside of the tubing string, and connects to the travelling assembly of the pump. Since the perforations in many wells are located several thousand feet below the surface level, it can be appreciated that running the tubing string and sucker rod down the well and removing them are considerably expensive service tasks. The tubing string task is a substantially larger task than the sucker rod task. Thus, engineers and suppliers, as well as the API (American Petroleum Institute), have designed pump configurations to address these service issues. For example, there are tubing pumps that are run down with the tubing string and rod insert pumps that are run down with the sucker rod. In the case of a rod insert pump, a seating nipple is run down with the tubing string, and the pump has a seating assembly, which engages the seating nipple when the pump is run down with the sucker rod string. Regardless of which type pump is used, the stationary assembly must be anchored to the tubing string and the travelling assembly reciprocated with the sucker rod. Since it is easier and less expensive to service the sucker rod, as compared to the tubing string, it isn't surprising that rod insert pumps are in common use.

In the case of the tubing pump, the pump's stationary assembly is run down with the tubing string and the pump's travelling assembly is run down with the sucker rod. In the case of a rod insert pump, both the stationary assembly and the travelling assembly are run down with the sucker rod. However, since the stationary assembly must be anchored to the tubing string, designers have incorporated an anchoring assembly with two components. These are referred to as a seating assembly, which is fixed to the pump's stationary assembly, and a seating nipple, which is fixed to the tubing string. Thus, the seating nipple is run down with the tubing string. The API has promulgated standards for the seating assemblies and seating nipples. There are two dominant types, mechanical and cup-type, which may be located at either the top of the pump or the bottom of the pump. The rod insert pumps are therefore referred to as top anchored and bottom anchored, respectively. In operation, a drive mechanism at the surface level drives the traveling portion of the downhole pump through the sucker rod. The surface drive unit is referred to as a pump jack, as are well known in the art. While there are a range of manufacturer and standardized designs for downhole pumps, the American Petroleum Institute (API), does promulgate certain pump standards, which conform to physical sizes and capacities, and to materials, interfaces and connections. A number of pump manufacturers adhere to the API pump specifications. In fact, alphanumerical pump designations include specifications for the tubing size, the pump barrel bore diameter, whether it is a rod or tubing pump, the seating assembly location, the seating assembly type, as well as the barrel length, plunger travel, and overall pump length.

In the case where an engineer selects a rod insert pump for a given well, the operator specifies the pump and seating nipple. The seating nipple is run down with the tubing string, and then the pump is run down with the sucker rod to engage the seating assembly with the seating nipple. In the case of a bottom seated pump, the pump inlet is generally at the lowest end of the seating assembly, with the standing valve of the pump directly above. In the case of the top seated pump, the lower end of the pump barrel has the pump inlet, with the standing valve immediately above. The illustrative embodiment highlighted in this disclosure is a bottom anchor design with a cup type seating assembly and seating nipple, which adhere to one of the API promulgated standards. Of course, all of the top and bottom seated pumps with both cup type and mechanical hold downs are applicable under the teachings of the present invention.

Reference is now directed to FIG. 1, which is a section view of an oil well 2 with rod insert pump 8, gas separator 12 and isolation means 16 according to an illustrative embodiment of the present invention. The well 2 is a conventional subterranean bore hole well with a steel casing 4 extending down to an oil and gas bearing geologic formation 18. A gas separator 12 is coupled to a conventional tubing string 6, which is used as the conduit through which oil is pumped out of the well. The gas separator 12 includes a specific seating nipple 14, which receives a seating assembly on the pump 8. In this embodiment, a rod insert pump 8 is employed. The pump 8 is coupled to and driven by a conventional sucker rod 10. The isolation means 16, which is a disc type flow diverter in this embodiment, is coupled to the lower end of the gas separator. The isolation means 16 serves to isolate the casing below the gas separator 12 from the annulus formed between the gas separator 12 and the interior of the casing 4, which is referred to as the separation annulus. This arrangement enables that annulus to serve as the separation chamber of the gas separation process. The design is advantageous in that the full annular area between the casing 4 and the gas separator barrel 12 is utilized to provide a relatively large cross sectional area of the separation chamber, thereby minimizing the downward velocity of the liquid. In addition, the separated liquid is very directly routed to the inlet of the pump 8 so as to minimize pressure losses due to flow through longer and more restricted passages in prior art separator designs. The separated gases rise upwardly in the casing 4 to the well head 22, where they are removed. Section lines A, B, and C will be more fully described with reference to FIGS. 12, 13, and 14, respectively.

The illustrative embodiment of FIG. 1 provides a number of design and operation features and benefits. The integral pump seating nipple 14 is located at the bottom of the gas separator 12 so that the pump inlet is adjacent to the liquid accumulated in the casing to separator annulus. The gas separator 12 is built using inner and outer barrels which are concentric, and the outside diameter the separator 12 is nearly identical to the outside diameter of the of the couplers used with the tubing string 6. The isolation means 16, which may be a pack-off assembly or diverter cups, is located at the bottom of the gas separator, and may further employ a tubing anchor or tubing catcher, as are known to those skilled in the art. The gas separator design can be used with a conventional pack-off assembly or a flow diverter consisting of elastomeric discs on a draw tube positioned below the well fluid inlet of the gas separator. The pressure drop across the separator is generally less than 10 psi so flexible elastomeric rings can be used instead of a high pressure pack-off assembly where otherwise appropriate. The gas separator includes a single fluid outlet (not shown in this drawing) at the top of the gas separator so that fluid flow impinges on the casing wall, thereby spreading the liquid into a film with circular downwards motion to facilitate gas-liquid separation. The gas separator includes a means for attaching a tail pipe to the bottom of the assembly of adequate length and diameter to minimize any multi-phase flow gradient between the separator and the producing formation.

With respect to the isolation means 16 in FIG. 1, all of the formation fluids must be directed into the bottom of the gas separator 12 to pass through the gas separator and be discharged out of the top of the gas separator. Then the discharged liquid in the casing annulus falls to the pump inlet and the gas flows upward in the casing 4. The flow can be directed into the gas separator using a conventional pack-off assembly, a set of flow diverter cups (shown in FIG. 1), or may include a pack-off assembly with a tail pipe. The pack-off assembly can withstands very high differential pressures, into the thousands of PSI. The diverter cup assembly is appropriate where differential pressures are much lower. The use of a tail pipe allows the formation fluids to be drawn from locations much deeper than the location of the gas separator. In some applications, that may be thousands of feet deeper. It is also useful to add check valve below the inlet of the gas separator. This is useful where a tail pipe is employed to prevent the fluids in the tail pipe from falling back down the well. The check valve is also useful in the case where a well produces slugs of fluids and gas, so that the check valve holds the fluids in the separator for subsequent pumping out of the well. The check valve is also useful to hold liquids above the check valve. For example, at the time a flow diverter is run down the well casing, water may be added to lubricated the diverter cups as the travel down the casing, thereby minimizing friction heat build up and possible damage to the diverter cups.

Figure 2:
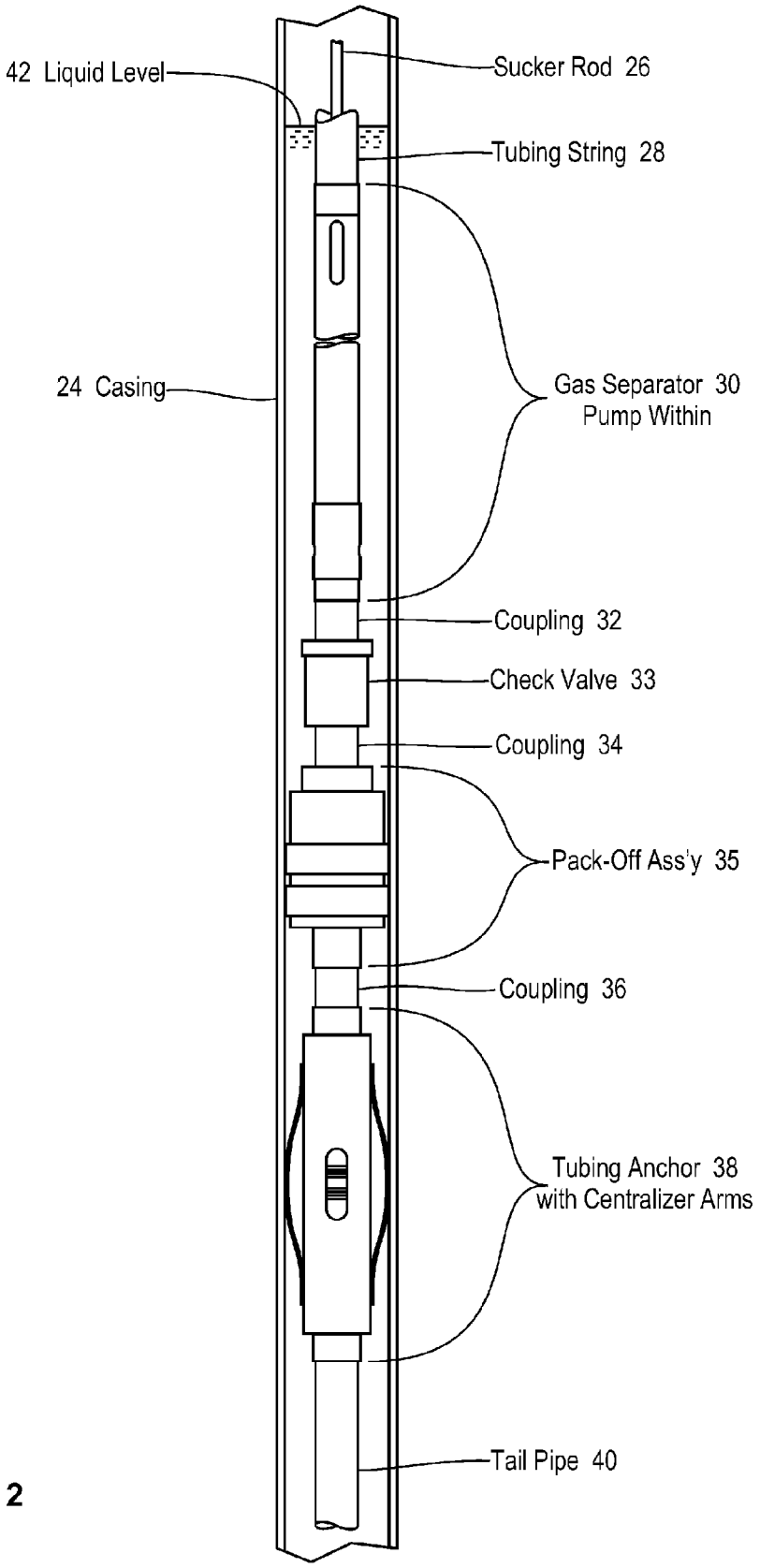
FIG. 2 is a partial section of an oil well with a gas separator, check valve, pack-off assembly, and tubing anchor according to an illustrative embodiment of the present invention.

Reference is directed to FIG. 2, which is a partial section view of an oil well with a gas separator 30, check valve 33, pack-off assembly 35, tubing anchor 38, and tail pipe 40 according to an illustrative embodiment of the present invention. This embodiment is suitable for deeper wells where the formation fluids are drawn from a deeper depth and where a high pressure differential exist above and below the isolation means. The well casing 24 is illustrated with a tubing string 28 having a sucker rod 26 disposed therein. The gas separator 30 exterior is illustrated, and it is to be understood that a sucker rod pump is disposed within the gas separator 30. A tubing connector 32 connects the fluid inlet of the separator 30 to a check valve 33, which is oriented to allow upward flow fluid flow only. Another tubing connector 34 connects the check valve 33 to a conventional pack-off assembly 35, as are known to those skilled in the art. The pack-off assembly 35 is run down with the tubing string, and is then expanded to sealably engage the interior wall of the well casing, thereby isolating the casing fluids above and below the pack-off assembly 35, which can withstand several thousand PSI pressure differentials. Thus, formation fluids can only pass upward through the central passage of the pack-off assembly 55, and into the check valve 33. In this embodiment, a tubing anchor with centralizer arms 38 is also attached to the pack-off assembly 35 using a tubing connector 36. The tubing anchor 38 is also run down with the tubing string, and once located, is expanded to mechanically engage the interior of the casing 24. The tubing anchor is load bearing, and fixedly locates the equipment at the position where it is engaged. This prevents vertical movement of the assembly during operation. The bore centralizer arms position the tubing anchor 38 near the geometric center of the casing 24, as is understood by those skilled in the art. Finally, a tail pipe 40 is connected to the tubing anchor 38, and extends downward to a depth where the designer wants the raw well fluids to enter the pumping system. This is one example of the anchor and tail pipe assembly, and it will be appreciated by those skilled that the art that other configurations are known, and would be selected based on well performance requirements.

With regards to embodiments similar to that illustrated in FIG. 2, the objective of a pack-off assembly type isolation means is to reproduce as closely as possible the flow characteristics that could be achieved if the pump intake were located below the bottom of the perforations, which enables the system to draw in fluids that contain a lesser percentage of gas. It is know in the art of oil and gas wells to employ a pack-off assembly (commonly referred to as a "packer") with a tubing anchor, which is used to rigidly fix the well's tubing string to the well casing at the location of the packer, and which may be deep in the well, and even at the location of a downhole pump. There are a number of technical reasons why it may be desirable to install a packer, but they are beyond the scope of this disclosure. While a packer may isolate the fluids below it from the fluids above it, the essential problems with using a packer as a casing flow isolation means is that the packer constricts movement of the tubing string along the vertical axis of the well. In fact, some tubing anchors incorporate a pack-off assembly. At any rate, the constriction must be addressed elsewhere in the well design, such as allowing the tubing string at the surface to move, or by adding tension to the tubing string at some point on its length. Otherwise, the expansion and contraction, and the forces of pump operation and fluid movement would cause undue stresses and buckling to occur. In addition, the installation and removal of a packer from a well requires a specialized process of inserting the packer unit, and then expanding it to engage the interior wall of the case, and the converse to remove it. There are many wells in operation, and many more that will be built in the future, where the use of a packer is simply not desirable. The use of a slidable flow diverter as taught in the present disclosure enables such wells to utilize the efficient gas separator of the present invention. Flow diverter type isolation means will be more fully discussed hereinafter.

Packer type separators have been in use for many years. Conventional wisdom considered that their application should be limited to wells where production of solids is minimal in order to reduce the potential of mechanical problems when the tubing needs to be retrieved. This concern was taken into account in the design of the present disclosure through use of an optimized separator design by minimizing the distance between the top of the packing element and the pump inlet so that the volume of solids that may settle in this part of the annulus is relatively small. In addition by locating the pump seating nipple in the immediate vicinity of the top of the packing element, it reduces the volume of solids that may accumulate inside the separator cavity.

With respect to the tail pipe 40 in FIG. 2, and its applicability, the tail pipe can reduce the gradient of fluids below a pump, where the pump is set above the formation. The tail pipe can increase the production rate of a well in most situations where the pump is set above the formation. Also, the tail pipe can be used with a packer-type isolation means. It has been determined that tail pipes with a smaller tube size reduces the pressure gradients of the gas/oil/water mixtures. In general, when the pump is set above the formation a considerable distance, the pressure drop will be less between the formation and the pump if tail pipe is used. Thus for any pump inlet pressure, such as 100 psi, which is common, the pressures at various depths below the pump are less and allow the operator to determine the PBHP (Producing Bottom Hole Pressure) and thus the producing rate efficiency of the well when the SBHP (Static Bottom Hole Pressure) is known. The tail pipe with packer configuration is very effective and will increase production in a well when the pump is set a considerable distance above the formation. The tail pipe reduces the pressure required to push the formation fluids to the pump so a lower PBHP exists. Field tests of separator performance indicate that better performance is obtained from downhole separators if the tubing anchor is located below the separator instead of above the separator.

Figures 3A, 3B:
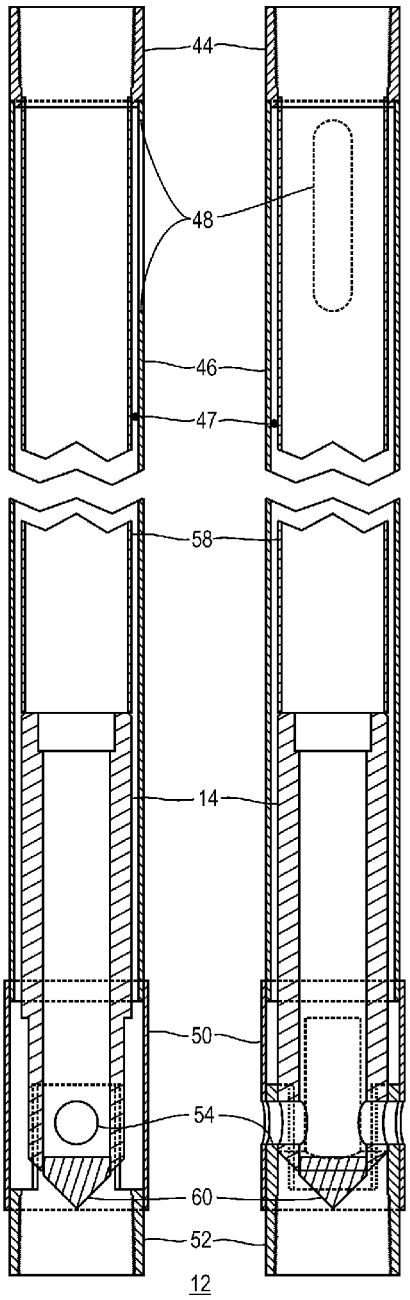
FIGS. 3A and 3B are section view drawings of a gas separator according to an illustrative embodiment of the present invention.

Reference is directed to FIGS. 3A and 3B, which are section view drawings of a gas separator 12 according to an illustrative embodiment of the present invention. These Figures correspond to the gas separator 12 in FIG. 1, and these FIGS. 3A and 3B show section views that are oriented ninety degrees apart to more clearly show the internal structure. The upper end of the separator 12 is a top collar 44, which is threaded to engage the standard pipe thread size for the tubing string that is applicable. Generally, the separator 12 is approximately the same diameter as the tubing string. There is an inner barrel 58 and an outer barrel 46 that are both sealably connected to the top collar 44. In the illustrative embodiment, they are welded together. The annulus between the inner barrel 58 and the outer barrel 46 is referred to as the well fluid annulus 47 because it is used as a passage through which the well fluids travel to exit the well fluid outlet 48. A single well fluid outlet 48 is illustrated, however, plural outlets can be used. The outlet 48 is adjacent the upper end of the outer barrel 46, which naturally provides a long path on the exterior of the outer barrel 46 for the separation annulus with the well casing (not shown).

The inner barrel 58 is sealably connected to the top of a seating nipple 14, which is compliant with a predetermined API specification. In this embodiment, it is a type RHB bottom anchored cup type seating pump. The pump is not shown in FIGS. 3A and 3B. The inner barrel 58 is welded to the seating nipple 14 in the illustrative embodiment. At the bottom end of the separator 12, there is an inlet fitting 52, which is threaded to suit the tubing string fitting sizes, in a similar fashion to the top collar 44. The well fluids enter the separator 12 through the inlet fitting 52, and enter the aforementioned well fluid annulus 47, then travel upwardly to eventually exit through the well fluid outlet 48. To complete the well fluid annulus, the outer barrel 46 must extend down to the inlet fitting 52. However, in this embodiment a slightly larger diameter lower outer barrel 50 is employed, which also improves manufacturability. These two outer barrel components are sealably coupled at both ends to perfect the sealed well fluid annulus 47. The purpose of the larger diameter lower outer barrel 50 is to provide adequate cross sectional area of the well fluid annulus in the area of the seating nipple 14, particularly where the well liquid passage 54 is located.

The well liquid passage 54 is a pair of holes formed through the lower outer barrel 50, and through the inlet fitting 52, and through the sides of the seating nipple 14, which provides a pathway for the well liquids that have separated in the separation annulus (not shown) to flow into the interior passage at the bottom of the seating nipple 14, and thereby enter the inlet of the pump (not shown). Note that the diameters of the lower outer barrel 50, the inlet fitting 52, and the seating nipple 14 are selected for a sealed fit, which isolates the well fluid annulus 47 from the well liquid passage 54. The lower end of the seating nipple 14 is closed with a tapered plug 60, which serves to direct well fluid flow from the inlet fitting 52 into the well fluid annulus 47. These flow arrangements will be more fully discussed hereinafter.

Figures 4A, 4B:
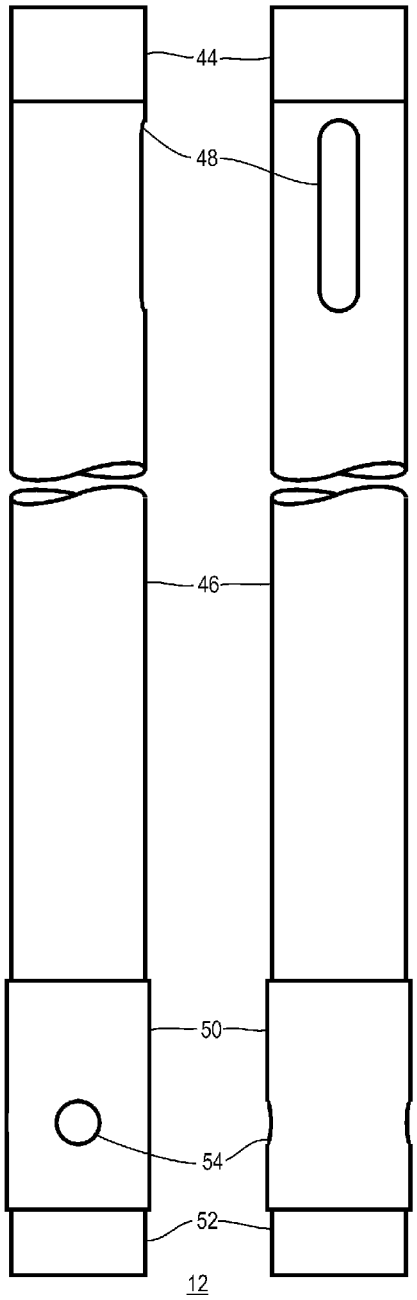
FIGS. 4A and 4B are side view drawings of a gas separator according to an illustrative embodiment of the present invention.

Reference is directed to FIGS. 4A and 4B, which are side view drawings of a gas separator 12 according to an illustrative embodiment of the present invention. These figures are consistent with the embodiment shown in FIGS. 1, 3A, and 3B. FIGS. 4A and 4B are exterior views, looking at ninety degree views from one another. At the lower end of the separator 12 is the inlet fitting 52, which is joined to the top collar 44 by the lower outer barrel 50 and the upper outer barrel 46. The well liquid passage 54 is located on the exterior of the lower outer barrel 50. The well fluid outlet 48 is located at the upper end of the upper outer barrel 46. The distance between the well fluid outlet 48 and the well liquid inlet defines the length of the separation annulus with the well casing (not shown). In the illustrative embodiment, the upper outer barrel is ninety-four inches, the top collar is four inches, the lower outer barrel is six inches, and the inlet fitting is four inches, totaling approximately one hundred eight inches.

Figures 5A, 5B:
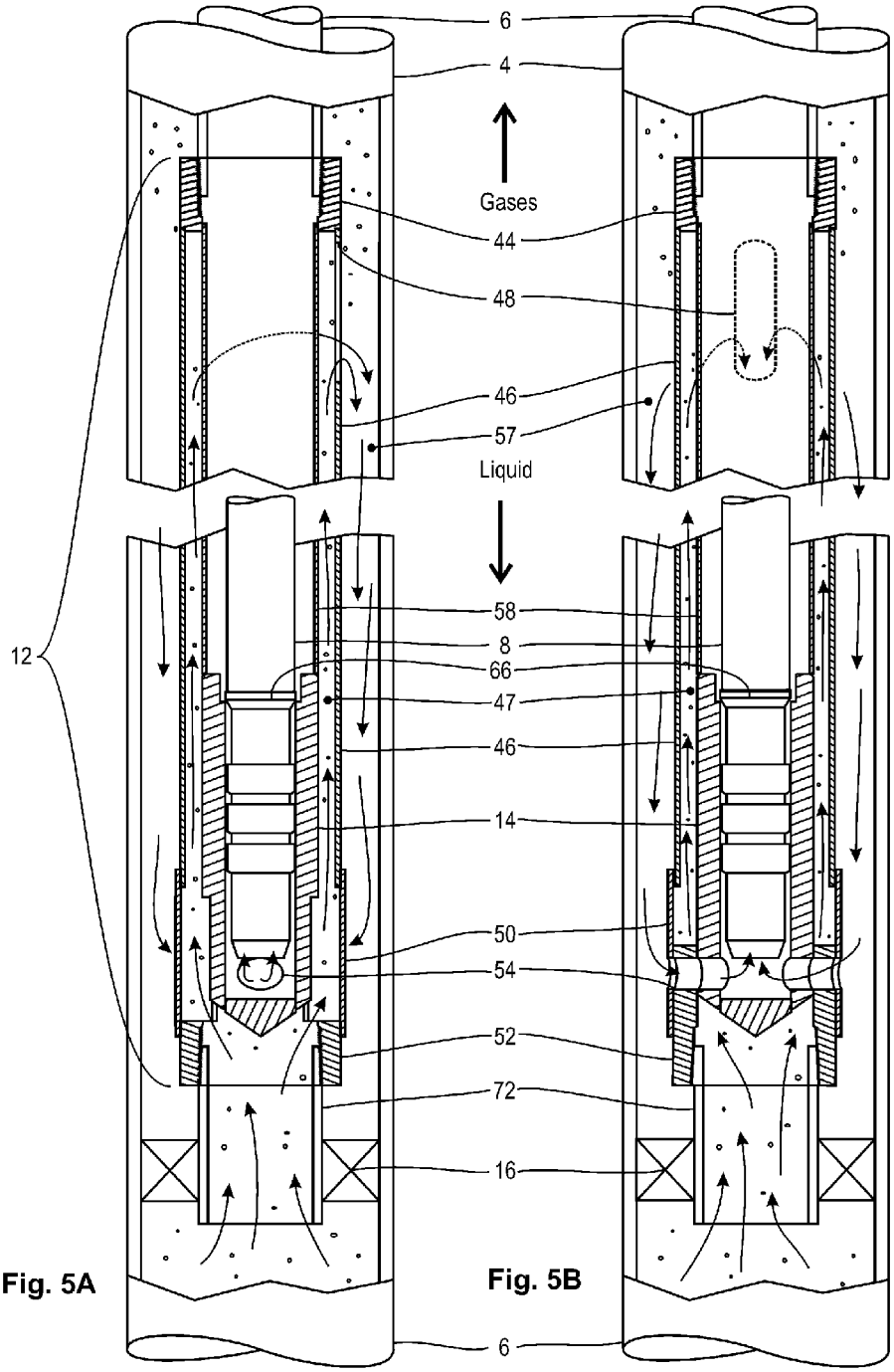
FIGS. 5A and 5B are section views of a gas separator showing fluid flow paths according to an illustrative embodiment of the present invention.

Reference is directed to FIGS. 5A and 5B, which are section views of a gas separator showing fluid flow paths according to an illustrative embodiment of the present invention. Again, the section views are taken at ninety degrees from one another to more clearly show the internal details. FIGS. 5A and 5B also comport with the illustrative embodiment of the FIGS. 1, 3A, 3B, 4A, and 4B. However, FIGS. 5A and 5B also incorporate a well casing 4, a tubing string 6, a pump 8 with seating assembly 66, a draw tube 72, and an isolation means 16. In these figures well liquid is illustrated with directional arrows and well gas with small bubbles. Note that the isolation means 16 isolates the separation annulus 57 from the open casing below the isolation means 16. Therefore, all of the well fluids that enter the pumping system must enter through the draw tube 72 and enter the inlet fitting 52 of the gas separator 12. As the well fluids enter the inlet fitting 52, they are routed into the well fluid annulus 47 and travel upwardly to exit the well fluid outlet 48. Also note that the motive force for the fluid movement is created by the suction pressure at the inlet of the pump 8, which is located at the bottom of the seating assembly 66. The seating assembly 66 is engaged with the seating nipple 14 portion of the gas separator 12.

As the well fluids exit the well fluid outlet 48 and enter the separation annulus 57, the cross sectional area increases and the fluid movement slows to a velocity of less than six inches per second. Gravity acts on the well fluid so that the gas bubble rise upwardly within the casing annulus while the liquid portion settles downwardly through the separation annulus 57 toward the well liquid inlet 54. The well liquids enter the well liquid passage and move into the pump inlet within a matter of a few inches of travel. This short distance and relatively minimal pressure differential are beneficial in preventing additional gases from being released from the liquid, and thereby diminishing the pump 8 efficiency. This is possible due to the design feature of incorporating the seating nipple 14 as a part of the gas separator 12, and also by accommodating a substantial portion of the pump 8 body and barrel within the gas separator 12. If the pump seating nipple were positioned above the gas separator well fluid outlet ports, a pressure drop in the liquids entering the pump would occur and gas would be released into the pump chamber. Additionally, if the well liquid passages were restrictive to flow, an excessive pressure drop occurs because of the high velocities associated with the pump plunger upward movement, which often approaches 80-100 inches per second on high pump capacity wells. Additionally, the standing valve of the pump 8 is located directly above the seating assembly portion 66. This results in a well liquid travel distance of approximately twelve to thirteen inches, at most, which is substantially less then in prior art systems where the entire gas separator was located below the pump inlet. Thus it can be appreciated that the features of the illustrative embodiment substantially improve pumping efficiency.

Figure 6:
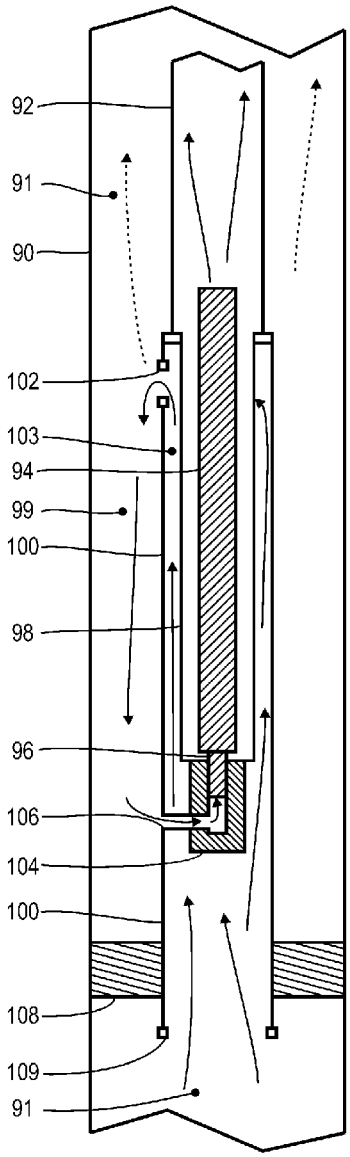
FIG. 6 is a schematic diagram of a downhole pump with a bottom hold down in a well according to an illustrative embodiment of the present invention.

Reference is directed to FIG. 6, which is a schematic diagram of a downhole pump 94 with a bottom hold down in a well according to an illustrative embodiment of the present invention. This figure is generally consistent with an API type RHB pump operating in an oil and gas well. The well casing 90 has a tubing string 92 disposed therein. The gas separator comprises an outer barrel 100 that is sealably coupled to the tubing string 92 it its upper end. The lower end of the outer barrel 100 extends downwardly to a point below an isolation means 108, and this presents the well fluid inlet 109 for the pumping system. An inner barrel 98 is disposed within the outer barrel 100. The inner barrel is also sealably coupled to the tubing string 92 at its upper end. Alternatively, it may be sealably coupled to the outer barrel 100. The lower end of the inner barrel 98 is sealably coupled to a seating nipple 104, which is also compliant with an API type RHB pump. The seating nipple 104 has a well liquid inlet passage 106 that couples to the exterior of the outer barrel 100, and this provides a conduit for well liquids to flow into the seating nipple 104, and into the inlet of a pump 94 though its seating assembly 96. The seating assembly 96 of the pump 94 engages the seating nipple 104, thereby locating and retaining the pump 94. The arrangement of these components defines a well fluid annulus 103 between the inner barrel 98 and the outer barrel 100, and also defines a separation annulus 99 between the outer barrel 100 and the casing 90.

FIG. 6 illustrates the well fluid and well liquid movement using solid lines with arrowheads, and illustrates separated gases using dashed lines with arrowheads. Well fluids enter the well fluid inlet 109 at the bottom of the outer barrel 100, and flow upwardly through the well fluid annulus 103. The well fluids exit a well fluid outlet 102 formed through the outer barrel 100 at it upper end, and into the separation annulus 99. Gravity then acts upon the well fluids such that the gases rise into the casing annulus 91 and exit the well therethrough. The well liquids fall through the separation annulus 99 and enter the well liquid passage 106 to enter the seating nipple 104 to the inlet of the downhole pump 94 through the lower end of the seating assembly 96. The pump 94 pumps the well liquids up through the tubing string 92.

Figure 7:
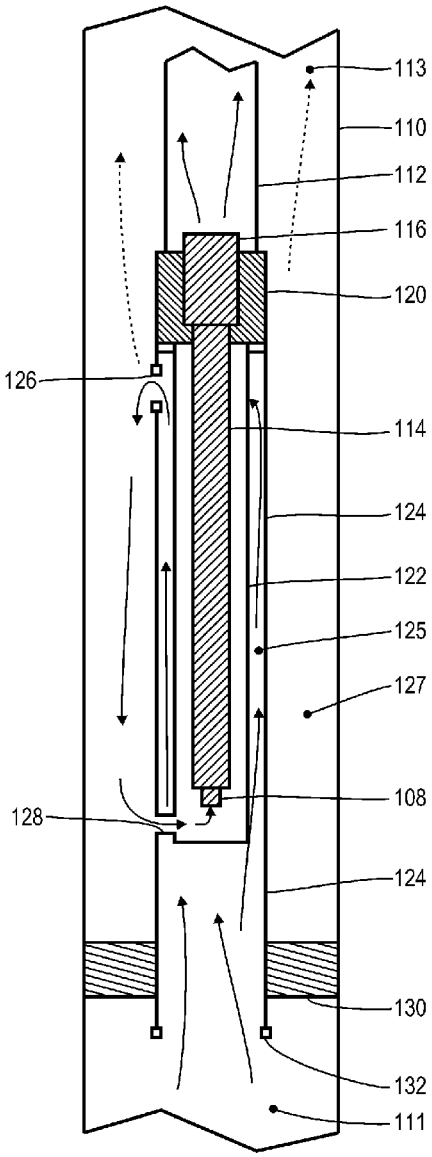
FIG. 7 is a schematic diagram of a downhole pump with a top hold down in a well according to an illustrative embodiment of the present invention.

Reference is directed to FIG. 7, which is a downhole pump 114 with a top hold down in a well according to an illustrative embodiment of the present invention. This figure is generally consistent with an API type RHA pump operating in an oil and gas well. The well casing 110 has a tubing string 112 disposed therein. The gas separator comprises an outer barrel 124 that is sealably coupled to a seating nipple 120 at its upper end. The seating nipple 102 is, in turn, sealably coupled to the tubing string 112. The lower end of the outer barrel 124 extends downwardly to a point below an isolation means 130, and thus presents the well fluid inlet 132 for the pumping system. An inner barrel 122 is disposed within the outer barrel 124. The inner barrel is also sealably coupled to the seating nipple 120 at its upper end. The lower end of the inner barrel 122 sealably encloses the lower end of pump 114, which presents the pump inlet 108 within the inner barrel 124. The seating nipple 120 is also compliant with an API type RHA pump. The lower end of the inner barrel 122 has a well liquid inlet passage 128 that couples to the exterior of the outer barrel 124, and this provides a conduit for well liquids to flow into the inner barrel 124, and into the inlet 108 of a pump 114. A seating assembly 116 at the upper end of the pump 114 engages the seating nipple 120, thereby locating and retaining the pump 114. The arrangement of these components defines a well fluid annulus 125 between the inner barrel 122 and the outer barrel 124, and also defines a separation annulus 127 between the outer barrel 124 and the casing 110.

The length of the inner barrel 122 and outer barrel 124 can be adapted to the specific length of the pump 114 by employing a coupling along their length so that two sections are used, and the length of the additional section is selected specific to the length of the pump. FIG. 7 further illustrates the well fluid and well liquid movement using solid lines with arrowheads, and illustrates separated gases using dashed lines with arrowheads. Well fluids enter the well fluid inlet 132 at the bottom of the outer barrel 124, and flow upwardly through the well fluid annulus 125. The well fluids exit a well fluid outlet 126 formed through the outer barrel 124 at it upper end, and into the separation annulus 127. Gravity then acts upon the well fluids such that the gases rise into the casing annulus 113 and exit the well therethrough. The will liquids fall through the separation annulus 127 and enter the well liquid passage 128 to enter the pump inlet 108 of the downhole pump 114. The pump 114 pumps the well liquids up through the tubing string 112.

Figure 8A:
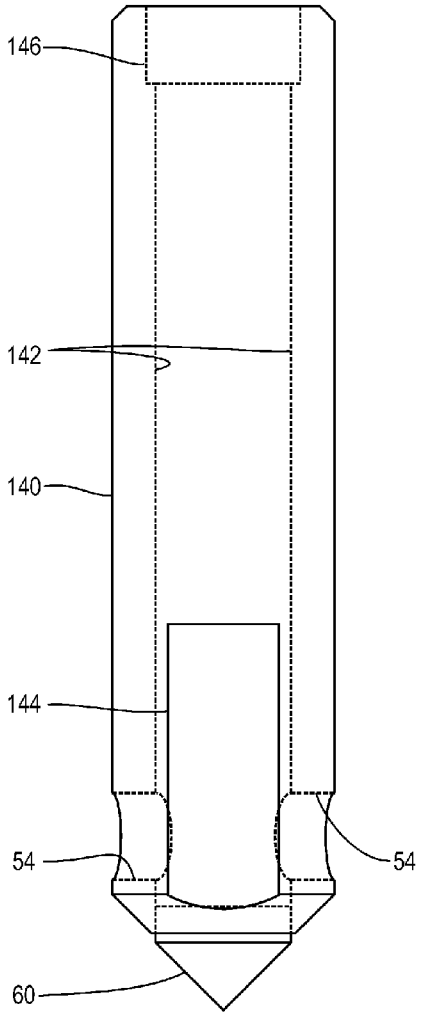
FIGS. 8A, 8B, and 8C are side view, end view, and section view drawings, respectively, of a seating nipple portion of a gas separator according to an illustrative embodiment of the present invention.
Figure 8C:
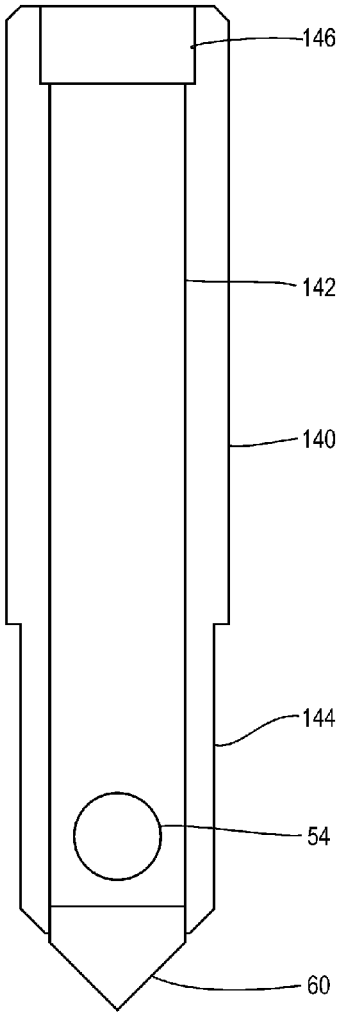
Figure 8B:
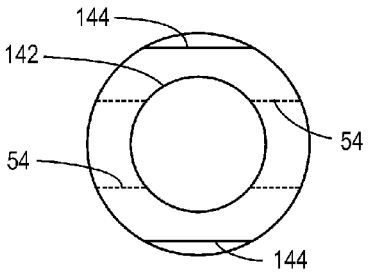

Reference is directed to FIGS. 8A, 8B, and 8C, which are side view, end view, and section view drawings, respectively of a seating nipple portion 14 of a gas separator according to an illustrative embodiment of the present invention. These figures are consistent with the illustrative embodiments of FIGS. 1, 3, 4, and 5. In the illustrative embodiment, the seating nipple 14 is fabricated from carbon steel, however many other alloys could be used, as will be appreciated by those skilled in the art. The seating nipple body 140 is generally cylindrical with a central bore 142 formed therethrough. A receiving portion 146 of the central bore is further formed at the upper end. The specific dimensions of the central bore 142 and receiving portion 146 follow the API seating nipple specification for the pump seating assembly intended for coupling thereto. These specifications are known to those skilled in the art. A pair of well liquid passage ports 54 are formed through the side walls of the seating nipple 14 at its lower end. The lower end of the seating nipple 14 central bore 142 is closed with a suitable plug 60, which is welded in place. Two flats 144 are formed on the outer surface of the seating nipple body 14 at is lower end, and are located at ninety degrees with respect to the well liquid passages 54. The flats 144 are provided to increase the flow area of the well fluid annulus in the area of the well fluid passages 54. The requirement for and size of the flats is determined by the flow rates and dimensions of the components in the gas separator, as will be appreciated by those skilled in the art. The flats also cooperate with upper extensions on the inlet fitting, as will be more fully discussed with respect to FIGS. 10A, 10B, and 10C.

Figure 9A:
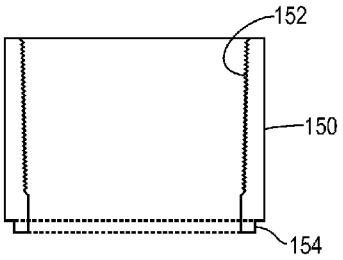
FIGS. 9A and 9B are side view and end view drawings, respectively, of a top collar portion of a gas separator according to an illustrative embodiment of the present invention.
Figure 9B:
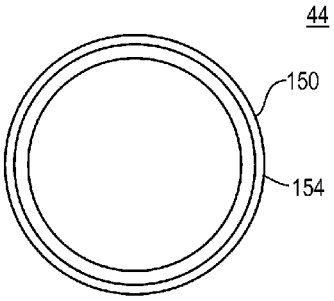

Reference is directed to FIGS. 9A and 9B, which are side view and end view drawings, respectively, of a top collar portion 44 of a gas separator according to an illustrative embodiment of the present invention. These figures are consistent with the illustrative embodiments of FIGS. 1, 3, 4, and 5. In the illustrative embodiment, the top collar is fabricated from type 316 stainless steel. The top collar 44 is threaded 152 according to the standard pipe thread requirement for the size of tubing string employed in the well. The lower end of the top collar is recessed 154 to receive the outer barrel (not shown), so as to provide a smooth exterior surface of the assembled gas separator. The inner barrel (not shown) slides into the interior of the top collar 44, and is welded in place.

Figure 10B:
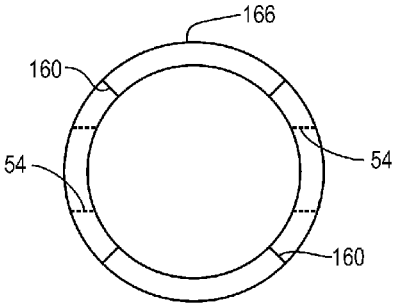
FIGS. 10A, 10B, and 10C are side view, end view, and section view drawings, respectively, of an inlet fitting portion of a gas separator according to an illustrative embodiment of the present invention.
Figure 10C:
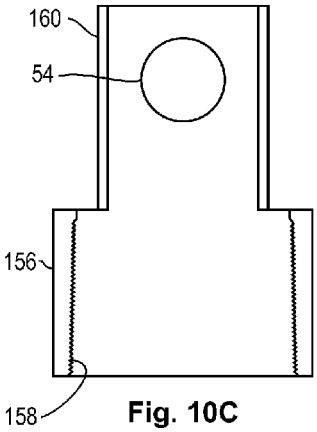
Figure 10A:
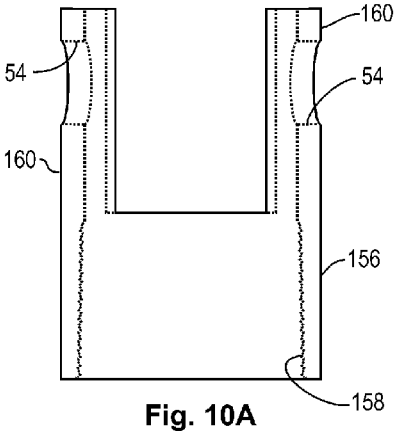

Reference is directed to FIGS. 10A, 10B, and 10C, which are side view, end view, and section view drawings, respectively, of an inlet fitting portion 52 of a gas separator according to an illustrative embodiment of the present invention. These figures are consistent with the illustrative embodiments of FIGS. 1, 3, 4, and 5. In the illustrative embodiment, the inlet fitting 52 is fabricated from type 316 stainless steel. The lower end 156 of the inlet fitting 52 is threaded 158 according to the thread specification of the target well tubing string size. The upper end of the inlet fitting 54 comprises two extensions 160, which each have a well liquid passage 54 formed therethrough. When the gas separator is assembled, the extensions fill the annular space between the seating nipple and the lower outer barrel to enable the well liquid passage 54 to sealably connect the separation annulus through to the interior of the seating nipple. The area between the extensions 166 provides the passageway from the inlet to the well fluid annulus.

Figure 11B:
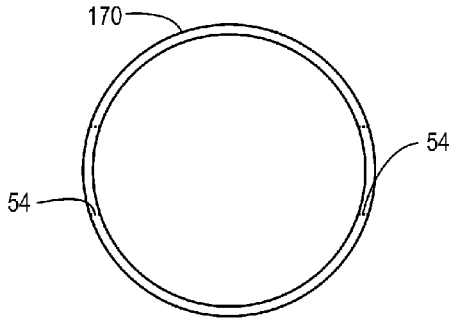
FIGS. 11A, 11B, and 11C are side view, end view, and section view drawings, respectively of a lower outer barrel portion of a gas separator according to an illustrative embodiment of the present invention.
Figure 11C:
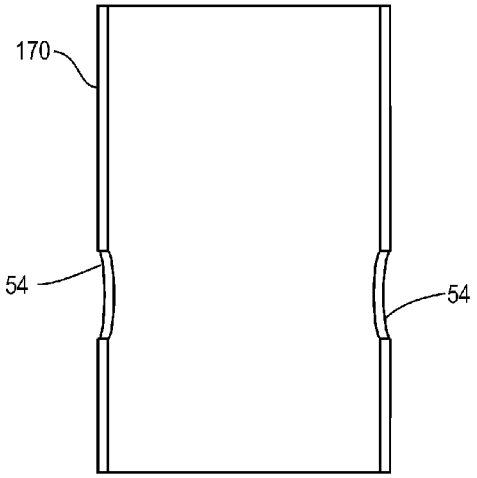
Figure 11A:
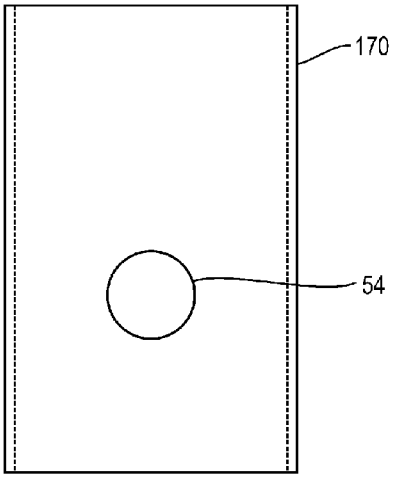

Reference is directed to FIGS. 11A, 11B, and 11C, which are side view, end view, and section view drawings, respectively of a lower outer barrel portion 50 of a gas separator according to an illustrative embodiment of the present invention. These figures are consistent with the illustrative embodiments of FIGS. 1, 3, 4, and 5. The lower outer barrel 50 is also fabricated from type 316 stainless steel. The inside diameter of the lower outer barrel 50 is the same dimension as the outside diameter of the upper outer barrel. When assembled, the lower outer barrel 50 slips over the upper outer barrel and is welded in place. A pair of well liquid passages 54 are formed through the lower outer barrel 50, and when assembled align with the passages formed in the inlet fitting and seating nipple.

Figure 12:
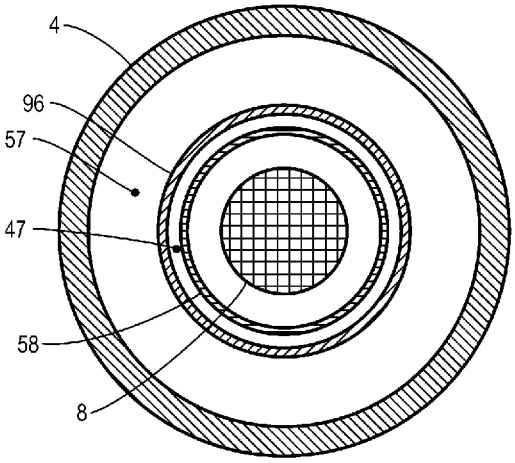
FIG. 12 is a section view drawing along the upper barrel portion of a gas separator according to an illustrative embodiment of the present invention.

Reference is directed to FIG. 12, which is a section view drawing along the upper barrel portion of a gas separator according to an illustrative embodiment of the present invention. This figure is consistent with the illustrative embodiments of FIGS. 1, 3, 4, and 5, and is referenced as "Section A" in FIG. 1. FIG. 12 shows the well casing 4, the upper outer barrel 96, the inner barrel 58, and the pump 8. The well fluid annulus 47 is located between the inner barrel 58 and the upper outer barrel 96. The separation annulus 57 is located between the upper outer barrel 96 and the casing 4.

Figure 13:
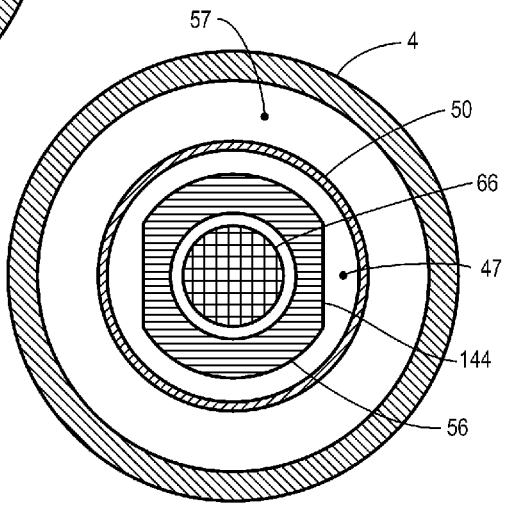
FIG. 13 is a section view drawing along the seating nipple portion of a gas separator according to an illustrative embodiment of the present invention.

Reference is directed to FIG. 13, which is a section view drawing along the seating nipple portion of a gas separator according to an illustrative embodiment of the present invention. This figure is consistent with the illustrative embodiments of FIGS. 1, 3, 4, and 5, and is referenced as "Section B" if FIG. 1. FIG. 13 shows the well casing 4, the lower outer barrel 50, the seating nipple 56, and the pump seating assembly 66. Note that the seating nipple 56 includes the two machined flats 144, which provide extra flow clearance in the well fluid annulus 47. In addition, the separation annulus is located between the casing 4 and the lower outer barrel 50.

Figure 14:
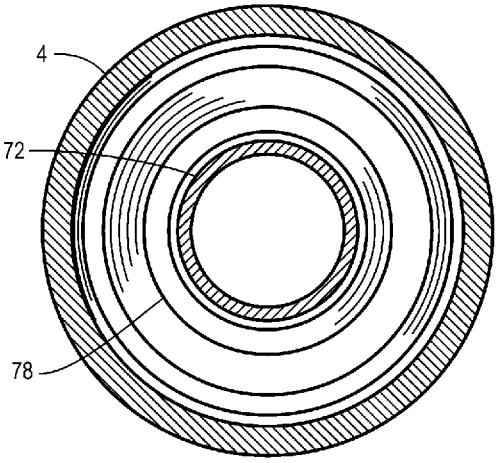
FIG. 14 is a section view drawing along a flow diverter according to an illustrative embodiment of the present invention.

Reference is directed to FIG. 14, which is a section view drawing along a flow diverter according to an illustrative embodiment of the present invention. This figure is consistent with the illustrative embodiments of FIGS. 1, 3, 4, and 5, and is referenced as "Section C" in FIG. 1. In FIG. 14, the casing 4 is illustrated as well as the inlet draw tube 72. A diverter disc 78 is visible. The diverter disc assembly will be more fully described hereinafter.

Figure 15:
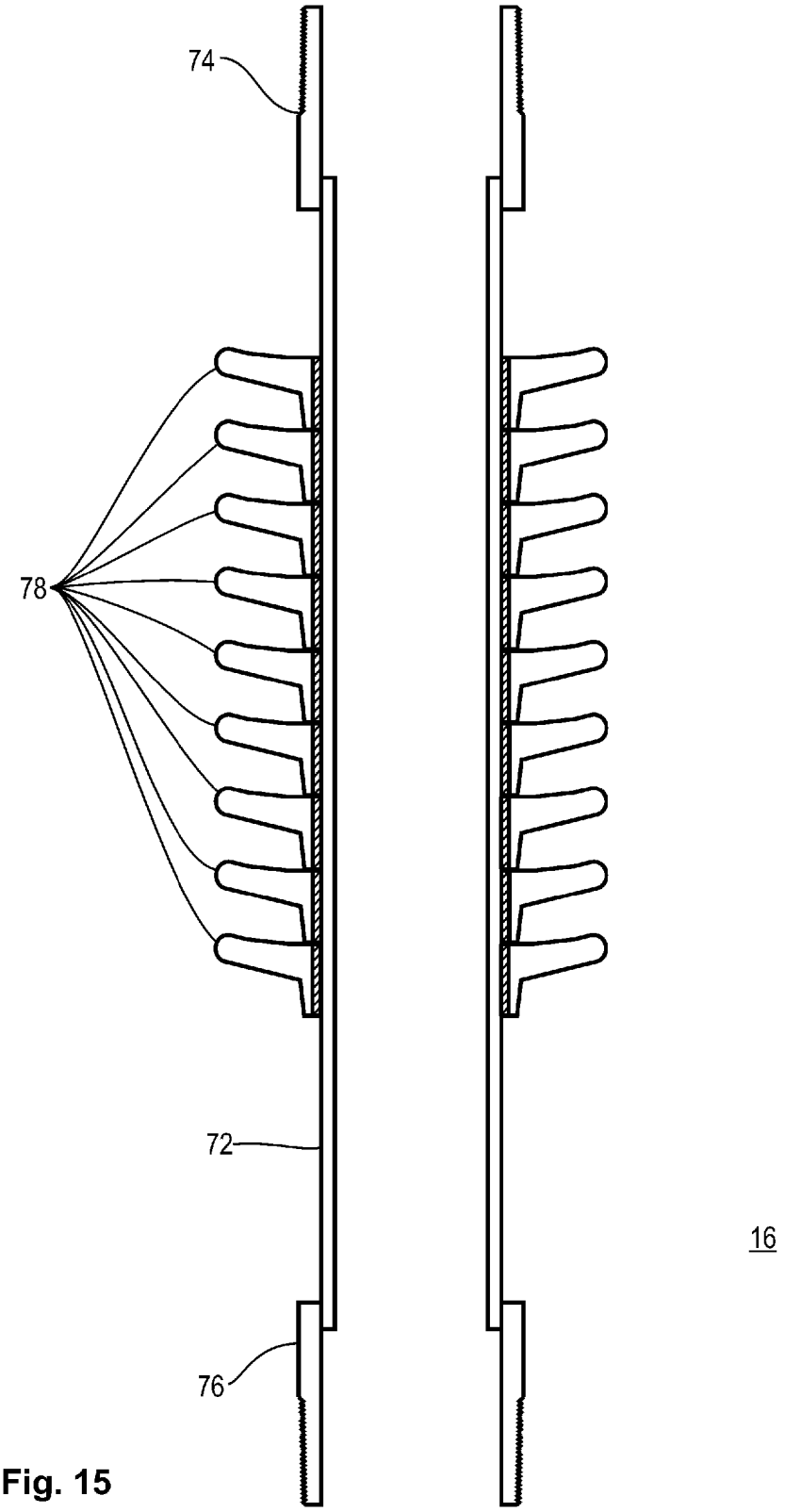
FIG. 15 is a section view drawing of a flow diverter according to an illustrative embodiment of the present invention.

Reference is directed to FIG. 15, which is a section view drawing of a flow diverter assembly 16 according to an illustrative embodiment of the present invention. This figure is consistent with FIG. 1. The flow diverter 16 in FIG. 15 is one embodiment of an isolation means of the present invention. The assembly consists of a draw tube 72 which has a first threaded coupler 74 at its upper end and second threaded coupler 76 at its lower end. The thread size is selected to match the thread standard for the tubing string employed in the target well. Along the length of the draw tube 72 are plural diverter discs 78, which slidably engage the draw tube 72. The discs' 78 outer portion is an elastomeric disc that may be cupped in shape, and which is sized to slidably engage the well casing of the target well. The diverter assembly 16 is run down the well with the gas separator and tubing string, and thus the discs 78 slide along the inner surface of the well casing. Wear and heat build-up are addressed by pouring water down the casing, and above the flow diverter assembly 16 as it is run down the well.

Figure 16A:
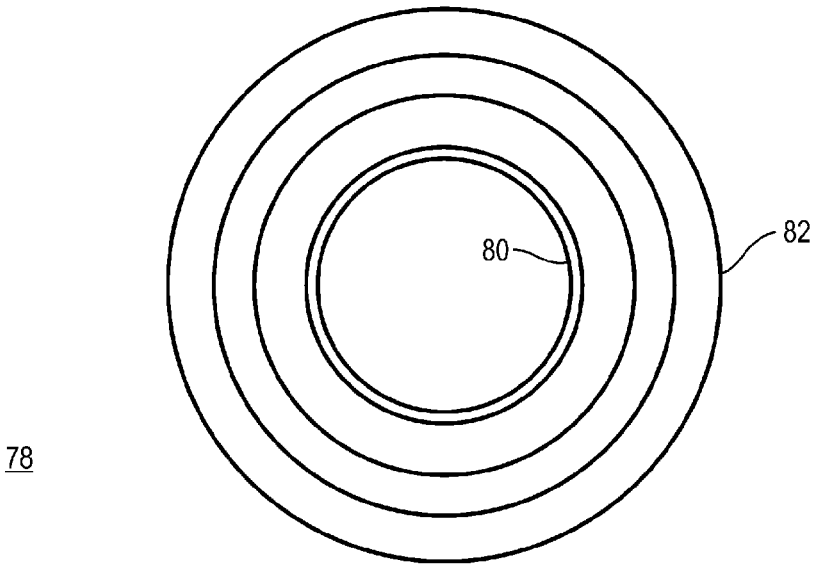
FIGS. 16A, 16B, and 16C are top view, side view, and section view drawing, respectively, of a flow diverter cup according to an illustrative embodiment of the present invention.
Figure 16B:
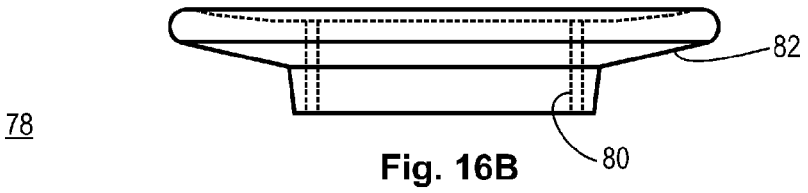
Figure 16C:
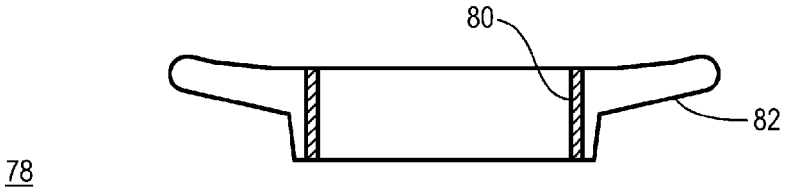

Reference is directed to FIGS. 16A, 16B, and 16C, which are top view, side view, and section view drawing, respectively, of a cupped type flow diverter disc 78 according to an illustrative embodiment of the present invention. The diverter disc 78 is molded from a polymeric material that is suitable for use with crude oil and well gases and has strength, flexibility, and abrasion resistance, such as polyethylene, acetal, fluoropolymers or fluoroethelenes. The outer rim 82 of the disc is rounded to facilitate sliding movement along the interior surface of the well casing (not shown). The disc is cupped and tapers along its upper and lower surfaces, and increases in thickness towards it interior so there is adequate area to support an embedded stainless steel sleeve 80. The sleeve 80 engages and supports the disc 60 to the draw tube (not shown).

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A gas separator for increasing liquid concentration of a well fluid, which includes a gaseous portion and a liquid portion, for use with a pump that has a seating assembly with a pump inlet, and which discharges into a tubing string that is located within a well casing, comprising:

a seating nipple with an interior cavity configured to engage and retain the seating assembly of the pump;

an inner barrel sealably coupled between the tubing string at its upper end and said seating nipple, and configured to accommodate a portion of the pump therein;

an outer barrel disposed about said inner barrel and said seating nipple, defining a well fluid annulus therebetween, and further defining a separation annulus that comprises the entire cross sectional area between the well casing and an exterior of said outer barrel, and having a well fluid outlet located above said seating assembly for communicating well fluids from said well fluid annulus to said separation annulus, and said outer barrel having a well fluid inlet located below said seating nipple, which enables well fluids to enter said fluid annulus;

a liquid passage disposed between said exterior of said outer barrel and said interior cavity of said seating nipple, thereby enabling well liquids to flow from said separation annulus into said interior cavity of said seating nipple and into the pump inlet;

an isolation means sealably disposed between the well casing and said separator, and located below said liquid passage and above said well fluid inlet, thereby preventing the flow of well fluids upwardly into said separation annulus, and wherein well fluids that flow into said separation annulus from said well fluid outlet are subject to gravity separation such that the gaseous portion rises within the separation annulus, and the liquid portion falls to said well liquid passage.

2. The gas separator of claim 1, and wherein:

said outer barrel is sealably coupled to said inner barrel at an upper end of said outer barrel.

3. The gas separator of claim 2, and wherein:

said well fluid outlet is formed through a sidewall of said outer barrel.

4. The gas separator of claim 3, and wherein:

said well fluid outlet comprises plural openings.

5. The gas separator of claim 1, further comprising:

a draw tube coupled to said well fluid inlet and extending downwardly therefrom, and wherein said isolation means is a flow diverter assembly disposed about said draw tube.

6. The gas separator of claim 5, and wherein:

said flow diverter further comprises plural separator discs that slidably engage said draw tube and the casing.

7. The gas separator of claim 1, and wherein:

said isolation means comprises a casing pack-off assembly coupled to said well fluid inlet, which prevents the flow of high pressure well fluid into and out of said separation annulus.

8. The gas separator of claim 7, further comprising:

tubing anchor coupled to said separator, which rigidly fixes said separator with respect to the casing.

9. The gas separator of claim 1, further comprising:

a tail pipe in fluid communication with said well fluid inlet and extending to a substantially greater depth in the casing than the depth of said separator in the casing, for drawing well fluids upward from said substantially greater depth.

10. The gas separator of claim 1, further comprising:

a check valve coupled to said well fluid inlet, and oriented to allow well fluid flow upwardly into said well fluid inlet only.

11. The gas separator of claim 1, and wherein:

said liquid passage is located less then twenty-four inches from the pump inlet.

12. The gas separator of claim 1, wherein the pump is a rod insert pump oil well pump with a cup type seating assembly, and wherein:

said seating nipple is a cup type seating nipple.

13. The gas separator of claim 1, wherein the pump is a oil well rod insert pump with a mechanical type seating assembly, and wherein:

said seating nipple is a mechanical type seating nipple.

14. The gas separator of claim 1, and wherein:

said outer barrel further comprises;

an upper outer barrel portion, and a lower outer barrel portion, which has a larger diameter than said upper outer barrel portion, and that is disposed about said seating nipple to provide increased clearance for well fluid flowing within said well fluid annulus.

15. The gas separator of claim 1, and wherein:

said inner barrel and said outer barrel are elongated with lengths within the range of three to forty feet.

16. The gas separator of claim 1, and wherein:

said isolation means is configured as a disc having an outer diameter selected to fit within an interior diameter of the casing, and having a mounting hole formed there through sized to engage an exterior surface of said outer barrel.

17. The gas separator of claim 16, and wherein:

said disc is formed of a polymeric material.

18. The gas separator of claim 17, and wherein:

said polymeric material is selected from selected from polyethylene, acetal, fluoropolymers and fluoroethelenes.

19. A gas separator for increasing liquid concentration of a well fluid, which includes a gaseous portion and a liquid portion, for use with a pump that has a seating assembly at its upper end and a pump inlet at a lower end of a pump body, and which discharges into a tubing string that is located within a well casing, comprising:

a seating nipple with an interior cavity configured to engage and retain the seating assembly of the pump;

an inner barrel, having its upper end sealably coupled to said seating nipple, and extending downwardly and about the pump to sealably enclose the pump body, including the pump inlet;

an outer barrel disposed about said inner barrel, sealably coupled to said seating nipple, thereby defining a well fluid annulus between said inner barrel and said outer barrel, and further defining a separation annulus that comprises the entire cross sectional area between the well casing and an exterior of said outer barrel, and having a well fluid outlet located adjacent to said upper end for communicating well fluids from said well fluid annulus to said separation annulus, and said outer barrel having a well fluid inlet located adjacent to the pump inlet, which enables well fluids to enter said fluid annulus;

a liquid passage disposed between said exterior of said outer barrel and said inner barrel at a location adjacent to the pump inlet, thereby enabling well liquids to flow from said separation annulus into said inner barrel and into the pump inlet;

an isolation means sealably disposed between the well casing and said separator, and located below said liquid passage and above said well fluid inlet, thereby preventing the flow of well fluids upwardly into said separation annulus, and wherein well fluids that flow into said separation annulus from said well fluid outlet are subject to gravity separation such that the gaseous portion rises within the separation annulus, and the liquid portion falls to said liquid passage.

20. The gas separator of claim 19, further comprising:

a draw tube coupled to said well fluid inlet and extending downwardly therefrom, and wherein said isolation means is a flow diverter assembly disposed about said draw tube.

21. The gas separator of claim 20, and wherein:

said flow diverter further comprises plural separator discs that slidably engage said draw tube and the well casing.

22. The gas separator of claim 19, and wherein:

said isolation means comprises a casing pack-off assembly coupled to said well fluid inlet, which prevents the flow of high pressure well fluid into and out of said separation annulus.

23. The gas separator of claim 22, further comprising:

tubing anchor coupled to said separator, which rigidly fixes said separator with respect to the casing.

24. The gas separator of claim 19, further comprising:

a tail pipe in fluid communication with said well fluid inlet and extending to a substantially greater depth in the casing than the depth of said separator in the casing, for drawing well fluids upward from said substantially greater depth.

25. The gas separator of claim 19, further comprising:

a check valve coupled to said well fluid inlet, and oriented to allow well fluid flow upwardly into said well fluid inlet only.

26. The gas separator of claim 19, and wherein:

said liquid passage is located less then twenty-four inches from the pump inlet.

27. The gas separator of claim 19, wherein the pump is a rod insert pump oil well pump with a cup type seating assembly, and wherein:

said seating nipple is a cup type seating nipple.

28. The gas separator of claim 19, wherein the pump is a oil well rod insert pump with a mechanical type seating assembly, and wherein:

said seating nipple is a mechanical type seating nipple.

29. The gas separator of claim 19, and wherein:

said inner barrel and said outer barrel are elongated with lengths within the range of three to forty feet.

30. The gas separator of claim 19, and wherein said inner barrel and said outer barrel are each comprised of two lengths of tubing joined by a coupler.

31. A gas separator for use in a well casing of a well that produces well fluids, including liquids and gases, and that employs a downhole pump having a seating assembly with a pump inlet disposed at its lower end, the well having a tubing string disposed within a well casing, the gas separator comprising:

a top collar with a central passage formed there through disposed at an upper end of said gas separator for coupling with the tubing string;

a seating nipple configured to receive and sealably engage the seating assembly of the downhole pump, thereby retaining the downhole pump in a fixed position with respect to the tubing string, said seating nipple having a liquid inlet near the pump inlet for delivering well liquids thereto;

an inlet fitting disposed at a lower end of said gas separator, having a well fluid inlet arranged to route well fluids about the exterior of said seating nipple;

a draw tube coupled to said inlet fitting that extends downward, thereby defining a lower annulus between the well casing and said draw tube;

a lower isolation means disposed about said draw tube, and which engages the well casing to prevent the flow of well fluids upwardly through said lower annulus;

an inner barrel sealably coupled between said seating nipple and said central passage of said top collar, and configured to accommodate the downhole pump therein, thereby enabling the downhole pump to discharge well liquids into the tubing string;

an outer barrel disposed about said inner barrel and said seating nipple, and sealably connected between said inlet fitting and said top collar, and having a well fluid outlet formed there through for delivering well fluids into a gravity separation annulus that comprises the entire cross sectional area formed between the well casing and said outer barrel, and having a liquid inlet passage formed there through, which couples well liquids to said liquid inlet of said seating nipple, and wherein said inner barrel and said outer barrel define a well fluid annulus there between, into which well fluids are coupled from said well fluid inlet of said inlet fitting, and wherein said well fluids are discharged from said well fluid annulus through said well fluid outlet into said gravity separation annulus such that the gases rise within said gravity separation annulus under force of gravity, and the liquids fall under force of gravity to said liquid inlet passage and into said liquid inlet in said seating nipple.

32. The gas separator of clime 31, and wherein:

said inner barrel is elongated to accommodate most of the length of the pump within said separator.

33. The gas separator of claim 31, and wherein:

said isolation means is a flow diverter assembly disposed about said draw tube.

34. The gas separator of claim 33, and wherein:

said flow diverter further comprises plural separator discs that slidably engage said draw tube and the well casing.

35. The gas separator of claim 31, and wherein:

said isolation means comprises a casing pack-off assembly coupled to said well fluid inlet, which prevents the flow of high pressure well fluid into and out of said gravity separation annulus.

36. The gas separator of claim 35, further comprising:

a tubing anchor coupled to said separator, which rigidly fixes said separator with respect to the casing.

37. The gas separator of claim 31, further comprising:

a tail pipe in fluid communications with said well fluid inlet and extending to a substantially greater depth in the casing than the depth of said gas separator in the casing, for enabling well fluids to flow upwardly from said substantially greater depth.

38. The gas separator of claim 31, further comprising:

a check valve coupled to said well fluid inlet, and oriented to allow well fluid flow upwardly into said well fluid inlet only.

39. The gas separator of claim 31, and wherein:

said liquid passage is located adjacent to the pump inlet.

40. The gas separator of claim 31, wherein the pump is a rod insert pump oil well pump with a cup type seating assembly, and wherein:

said seating nipple is a cup type seating nipple.

41. The gas separator of claim 31, wherein the pump is a oil well rod insert pump with a mechanical type seating assembly, and wherein:

said seating nipple is a mechanical type seating nipple.

42. The gas separator of claim 31, and wherein:

said outer barrel further comprises;

an upper outer barrel portion, and a lower outer barrel portion, which has a larger diameter than said upper outer barrel portion, and that is disposed about said seating nipple to provide increased clearance for well fluid flowing within said well fluid annulus.

43. The gas separator of claim 31, and wherein:

said inner barrel and said outer barrel are elongated with lengths within the range of three to forty feet.

* * * * *